United States Patent [19]

Krieger

[11] 4,303,427

[45] Dec. 1, 1981

[54] CASCADE MULTICOMPONENT COOLING METHOD FOR LIQUEFYING NATURAL GAS

[76] Inventor: Heinrich Krieger, Leitlestrasse 16, 8100 Garmisch-Partenkirchen, Fed. Rep. of Germany

[21] Appl. No.: 23,089

[22] Filed: Mar. 22, 1979

Related U.S. Application Data

[63] Continuation of Ser. No. 808,621, Jun. 21, 1977, abandoned.

[30] Foreign Application Priority Data

Jun. 23, 1976 [DE] Fed. Rep. of Germany ..... 2628007

[51] Int. Cl.[3] ..... F25J 1/02

[52] U.S. Cl. ..... 62/9; 62/40; 62/23; 62/335; 62/510

[58] Field of Search ..... 62/9, 23, 40, 335, 510

[56] References Cited

U.S. PATENT DOCUMENTS 3,218,816 11/1965 Grenier ..... 62/40
3,702,063 11/1972 Etzbach et al. ..... 62/40
3,780,535 12/1973 Darredeau ..... 62/40

FOREIGN PATENT DOCUMENTS 2242998 3/1974 Fed. Rep. of Germany ..... 62/40
49-88903 8/1974 Japan ..... 62/40

*Primary Examiner*—Norman Yudkoff
*Attorney, Agent, or Firm*—Michael J. Striker

[57] ABSTRACT

A cooling arrangement to be used in liquefying natural gas and in similar applications and having an incorporated cascade circuit with a fractional condensation of a cooling medium and with separation of the phases of the cooling medium, has such a lay-out and is so operated that the warming-up of the expanded cooling medium in a countercurrent evaporative heat exchange and the warming-up of the expanded cooling medium in a countercurrent supercooling heat exchange are in parallel to one another. The separated gaseous phase of the cooling medium is cooled in the countercurrent evaporative heat exchange to be at least partially condensed. The countercurrent supercooling heat exchange and the countercurrent evaporative heat exchange are thermally segregated from one another.

4 Claims, 2 Drawing Figures

CASCADE MULTICOMPONENT COOLING METHOD FOR LIQUEFYING NATURAL GAS

This is a continuation, of application Ser. No. 808,621, filed June 21, 1977, now abandoned.

BACKGROUND OF THE INVENTION

The present invention relates to a cooling method and to the associated apparatus.

Various cooling methods and associated cooling arrangements have already been proposed and are in widespread use in various branches of the industry and elsewhere. Among such uses, there is simple cooling, refrigeration, freezing and the use in cryogenics. There has been already proposed a method in which a cooling medium is circulated in at least one cooling circuit in which the cooling medium is sequentially compressed and cooled by an ambient cooling fluid, the compressed cooling medium condensed, expanded, heated, evaporated and then recirculated to a compressor. It has also been already proposed to provide at least one cooling circuit as an incorporated cascade circuit in which a mixture is used as the cooling medium and in which the condensation of the compressed cooling medium is a fractional condensation which includes at least one partial condensation. Then, the partially condensed cooling medium is subjected to a phase separation and then the cooling medium which is in the form of a condensate is supercooled by an expanded and warming up cooling medium in a countercurrent supercooling heat exchange, then expanded and then warmed up with accompanying evaporation in a countercurrent evaporative heat exchange. On the other hand, the cooling medium separated in its vapor phase is cooled in a countercurrent evaporative heat exchange and thus at least partially condensed. It has also been proposed, in this context, to thermally segregate the countercurrent supercooling and evaporation heat exchange from one another.

In the known methods, the heating of the expanded cooling medium in the countercurrent evaporative heat exchange, and the heating of the expanded cooling medium in the countercurrent supercooling heat exchange are performed in series after one another, that is, the expanded cooling medium enters, after its issuance from the countercurrent evaporative heat exchange, the countercurrent supercooling heat exchange at the cold end thereof. Thus, the cooling medium is subjected to a considerable temperature rise after its expansion and prior to its entry into the countercurrent supercooling heat exchange as a result of the heating and evaporation thereof in the countercurrent evaporative heat exchange. Subsequent to the expansion, the cooling medium will usually be substantially in its liquid phase at or close to its boiling point, which contributes to the thermodynamic optimization of the method in that the temperature of the cooling medium remains virtually unchanged during the expansion. In order that the cooling medium which enters the countercurrent supercooling heat exchange at the cold end thereof be capable of cooling the cooling medium to be supercooled down to this temperature, the temperature rise experienced by the cooling medium in the countercurrent evaporative heat exchange must be compensated for by the admixture of a substantial amount of the cooling medium which is at a considerably lower temperature than the cooling medium to which it is admixed. A mixture of cooling media which are at substantially different temperature, however, detracts from the thermodynamic optimization of the method.

SUMMARY OF THE INVENTION

Accordingly, it is a general object of the present invention to avoid the above-discussed disadvantages.

More particularly, it is an object of the present invention to devise a cooling method which is not possessed of the disadvantages of the prior-art methods.

Still more particularly, it is an object of the present invention to improve the thermodynamic optimization of the above-discussed method.

Yet another object of the present invention is to provide a method rendering it possible to obtain a relatively high thermodynamic efficiency while resorting to a relatively small heat-exchange area.

A concomitant object of the present invention is to so construct a cooling apparatus as to be capable of performing the above-discussed method.

A still further object of the invention is to so design the cooling apparatus as to be simple in construction, reliable in operation, inexpensive to manufacture and capable of performing the above method in an optimum manner.

The above-enumerated objects are achieved, according to the present invention, in that the heating of the expanded cooling medium in the countercurrent evaporative heat exchange and the heating of the expanded cooling medium in the countercurrent supercooling heat exchange are performed in parallelism with one another.

According to the preferred embodiments of the present invention, the expanded cooling medium enters the cool end of the countercurrent evaporative heat exchange substantially as a boiling liquid, or a substantially boiling liquid is admixed to the cooling medium entering the cool end of the concurrent evaporation heat exchange. Herein, the cooling medium is present subsequent to the expansion substantially as a boiling liquid so that the temperature thereof virtually does not change during the expansion. Therefore, the cooling medium enters the countercurrent evaporative heat exchange at the cold end thereof at substantially the same temperature, or is admixed to the cooling medium entering the countercurrent evaporative heat exchange at the cool end thereof at substantially the same temperature, as that at which it leaves the countercurrent supercooling heat exchange at the cool end thereof. The cooling medium which warms up upon its entry into the countercurrent evaporative heat exchange at the cool end thereof is not further heated in the countercurrent supercooling heat exchange, as a result of the thermal segregation of the countercurrent supercooling and evaporative heat exchanges as proposed by the present invention, so that the absence of a temperature difference between the cooling medium entering the countercurrent evaporative heat exchange at the cool end thereof and the cooling medium leaving the countercurrent supercooling heat exchange at the cold end thereof results in a situation where the temperature differences in the countercurrent supercooling heat exchange are not reduced below their optimum values. Herein, the thermal segregation present at the cool end of the countercurrent supercooling heat exchange has its effects at the cool end of the countercurrent supercooling heat exchange, while the thermal segregation existing in the course of the countercurrent supercooling heat exchange has its effects in the course of the countercurrent supercooling heat exchange. The contribution of the thermal segregation of the countercurrent supercooling and evaporation heat exchange to an optimum temperature differences is the greatest at the cool end of the countercurrent supercooling heat exchange, then gradually diminishes between the cool and the warm end thereof, and disappears at the warm end of the countercurrent supercooling heat exchange.

A condensating cooling medium is being cooled and an evaporating cooling medium is being heated in the countercurrent evaporative heat exchange, as a result of which, due to the cooling and the condensation, the specific volume of the one cooling medium decreases and, due to the heating and the evaporation, the specific volume of the other cooling medium increases. The cooling medium which is substantially completely in a liquid condition, is cooled in the countercurrent supercooling heat exchange and, according to one embodiment of the invention, the cooling medium which is substantially completely in vaporized state is heated therein so that the specific volume of the one or the other cooling medium remains virtually the same despite the cooling or heating of the respective cooling medium. This volume behavior of the cooling media which are in countercurrent heat exchange contributes to the optimization of the heat exchange area. Such is possible in the known methods only when the warming-up cooling medium is totally evaporated in the countercurrent evaporative heat exchange while, in the present inventive method, such is also present when the warming cooling medium is only partially evaporated in the countercurrent evaporative heat exchange. This results in an increased flexibility of the inventive method.

Further embodiments of the invention propose that the cooling medium segregated during the phase separation as vapor be substantially totally condensed in the countercurrent evaporative heat exchange, that the cooling medium which warms up in the countercurrent supercooling heat exchange be at the same pressure as the cooling medium warming up in the countercurrent evaporative heat exchange, that the cooling medium warmed up in the countercurrent evaporative heat exchange leave the latter as exactly saturated steam, and that the cooling medium to be warmed up in the countercurrent supercooling heat exchange be admitted into the latter as exactly saturated steam.

According to still further concepts of the present invention, the incorporated cascade circuit is closed and the cooling medium is compressed in the incorporated cascade circuit in at least two stages, and the cooling medium which is cooled in the countercurrent supercooling heat exchange is reduced in pressure during expansion thereof to a relatively intermediate pressure and is warmed up in a countercurrent heat exchange with a gas mixture to be liquified, which heat exchange is substantially thermally segregated from the countercurrent evaporative heat exchange as well as from the countercurrent supercooling heat exchange, into which heat exchange the cooling medium enters substantially as a liquid at or close to the boiling point and in which heat exchange the gas mixture to be liquified is substantially totally condensed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Before entering a discussion of the prepared embodiment, it is to be mentioned that the illustrated flow diagrams are illustrative only. The same is also valid for the temperatures, pressures and compositions which will be mentioned as the discussion progresses.

Figure 1:
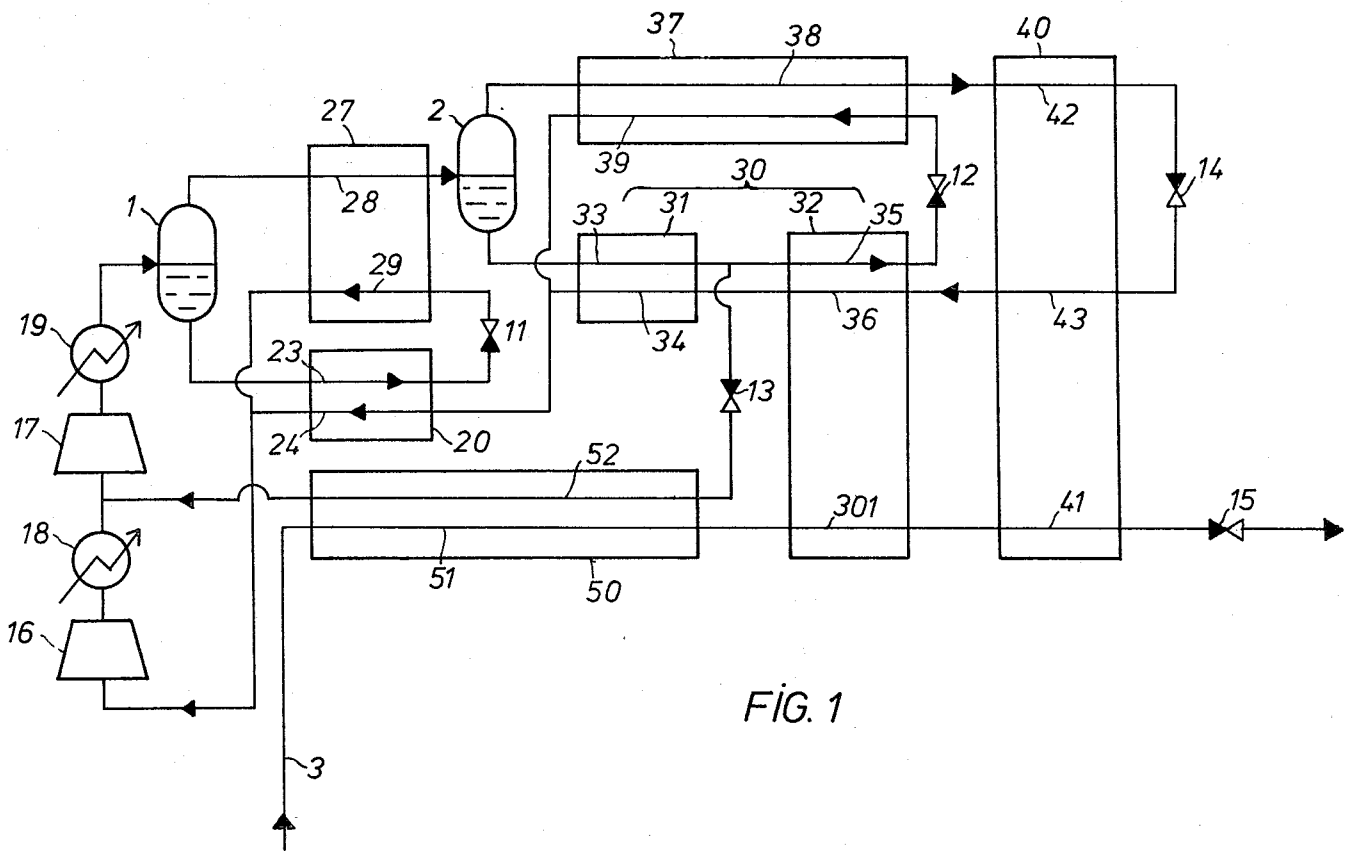
FIG. 1 is a somewhat diagrammatic simplified flow diagram of a cooling apparatus according to the present invention.

Referring now to the drawing in detail, and first to FIG. 1 thereof, a cooling arrangement which is capable of performing the method of the present invention includes an evaporative heat exchanger 37, a supercooling heat exchanger 30 which is arranged in parallel to the evaporative heat exchanger 37, a further evaporative heat exchanger 27, a supercooling heat exchanger 20 which is arranged in parallel to the evaporative heat exchanger 27, as well as further heat exchangers 40 and 50. In this embodiment of the present invention, the supercooling heat exchanger 30 consists of two partial heat exchangers 31 and 32.

Dried and pre-purified natural gas at an ambient temperature of approximately 25° C., at a pressure of approximately 40 kg/cm$^2$, and having a composition of approximately 85 molar percent methane, 10 molar percent ethane and 5 molar percent propane is introduced into the arrangement through a conduit 3 and passes first through a flow channel 51 and then in sequence through flow channels 301 and 41 of the respective heat exchangers 50, 30 or 32, and 40. In the heat exchanger 50, the natural gas is cooled to a temperature of approximately −80° C. and, as a result thereof, it is substantially fully condensed. The condensate is then further cooled in the heat exchangers 32 and 40 to a temperature which substantially corresponds to its boiling temperature at atmospheric pressure, that is, to approximately −155° C. Thereafter, the pressure of the condensate is reduced, in a reducing valve 15, to approximately the atmospheric pressure corresponding to the storing pressure while substantially no evaporative losses occur, and then it is conducted to a non-illustrated conventional storage container.

A cooling medium of an incorporated cascade cooling circuit contains approximately 5 molar percent of nitrogen, 50 molar percent of methane, 15 molar percent of ethane and 30 molar percent of propane. Such cooling medium is compressed in a second compressing stage 17 to approximately 45 kg/cm$^2$ and is cooled in a cooler 19 arranged downstream of the second compressing stage 17 with a cooling water. As a result of such cooling, the cooling medium is partially condensed. The partially condensed cooling medium is conducted to a phase separator 1 wherein the still gaseous component of the cooling medium is separated from the already condensed component. The phase separator 1 is of a conventional construction.

The cooling medium which is separated in the phase separator 1 and which is still in its vaporous state is cooled in a flow channel 28 of the evaporative heat exchanger 27 to about −70° C. and, as a result of such cooling, partially condensed. The partially-condensed cooling medium is then conducted into a phase separator 2, again of conventional construction.

The cooling medium which is withdrawn from the phase separator 2 as a vapor is cooled in a flow channel 38 of the evaporative heat exchanger to approximately −110° C. and thus condensed in its entirety. The fully condensed cooling medium exits from the heat exchanger 37 substantially as a boiling liquid. After that, such liquid is conveyed through the heat exchanger 40 in a flow channel 42 concurrently with the natural gas which flows through the heat exchanger 40 in the flow channel 41, the liquid being thus cooled to approximately −155° C. The supercooled cooling medium is conducted to a throttle 14 where it is reduced in its pressure to approximately 3 kg/cm$^2$, whereupon it exists as a vapor-liquid mixture with a small proportion of vapor. The cooling medium the pressure of which has been reduced flows through a flow channel 43 of the heat exchanger 40 in countercurrent to the flow of the natural gas through the flow channel 41, so that such reduced-pressure cooling medium evaporates in its entirety. Then, such evaporated cooling medium in the form of exactly saturated steam enters the supercooling heat exchanger 30 and flows seritim through the partial heat exchangers 32 and 31 thereof via flow channels 36 and 34, respectively.

On the other hand, the cooling medium which is separated in the phase separator 2 as a condensate flows through a flow channel 33 of the partial heat exchanger 31 of the supercooling heat exchanger 30, as a result of which it is supercooled to approximately −110° C. A part of the supercooled cooling medium is branched off and the pressure of such part is reduced in a throttle 13 to approximately 10 kg/cm$^2$. Under these circumstances, the reduced-pressure cooling medium is substantially a boiling liquid, and such liquid flows through a flow channel 52 of the heat exchanger 50 in countercurrent to the natural gas flowing through the flow channel 51 thereof, so that such liquid is totally evaporated and superheated.

The other part of the cooling medium which has been supercooled in the heat exchanger 31 is further supercooled to a temperature of approximately −120° C. in a flow channel 35 of the heat exchanger 32. Thereafter, the pressure thereof is reduced in a throttle 12 to approximately 3 kg/cm$^2$, as a result of which it assumes the state of substantially a boiling liquid. The reduced-pressure cooling medium is totally evaporated in a flow channel 39 of the evaporative heat exchanger 37 and leaves the latter substantially as a dry saturated steam. Thereafter, such steam joins with the cooling medium warmed up in the heat exchanger 31 and is further warmed up in a flow channel 24 of the supercooling heat exchanger 20.

The cooling medium which is withdrawn from the phase separator 1 as a condensate is supercooled in a flow channel 23 of the supercooling heat exchanger 20 to approximately −80° C. and the pressure thereof is reduced in a throttle 11 to approximately 3 kg/cm$^2$, as a result of which it achieves a state of substantially a boiling liquid. The reduced-pressure cooling medium is warmed up in a flow channel 29 of the evaporative heat exchanger 27 and leaves the latter substantially as exactly saturated steam. Thereafter, such steam joins the cooling medium which has been warmed up in the supercooling heat exchanger 20 and then returned to a first compressing stage 16. In the latter, the cooling medium is compressed to approximately 10 kg/cm$^2$, and then it is cooled with cooling water in an intermediate cooler 18. The cooling medium which is withdrawn from the intermediate cooler 18 is joined with the cooling medium warmed up in the heat exchanger 50 and, finally, the cooling medium is recirculated to the inlet of the second compressing stage 17.

It is proposed, according to a further embodiment of the invention, to compress the cooling medium to a relatively high pressure in at least two stages of the incorporated cascade circuit, and then reduce the pressure of the cooling medium which has been separated during the phase separation as a condensate and which has been subsequently supercooled, to a relatively intermediate pressure, and to totally condense, supercool and pressure-reduce the cooling medium separated during the phase separation as a vapor and heat the same in a countercurrent supercooling heat exchange.

Figure 2:
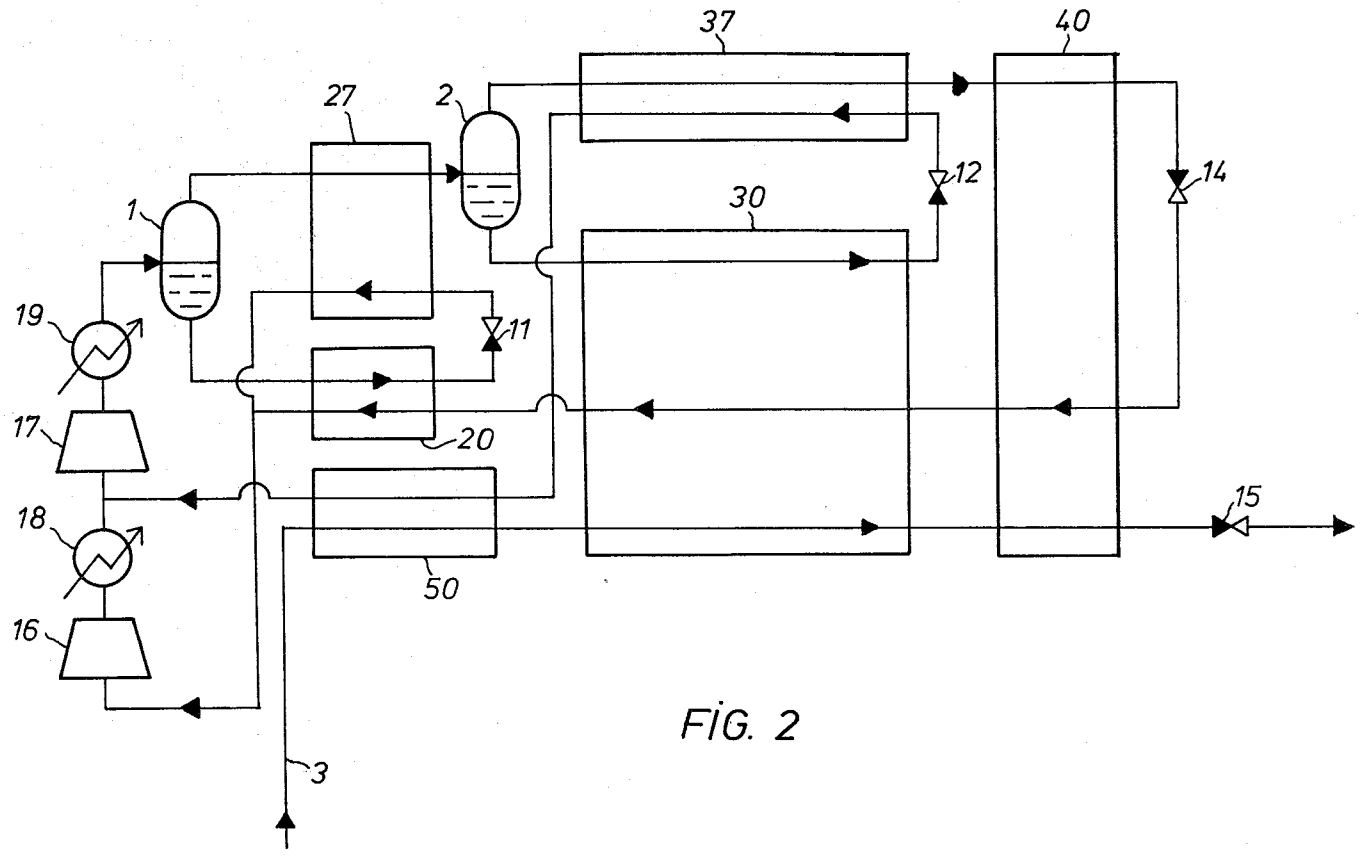
FIG. 2 is a view similar to FIG. 1 but of a modification of the latter.

This embodiment of the present invention is illustrated in FIG. 2 by way of an example. In this Figure, the same reference numerals as those used in FIG. 1 have been utilized to designate the same or similar parts. In contradistinction to the embodiment of FIG. 1, in the arrangement of FIG. 2, the cooling medium is reduced in pressure in the throttle 12 only to an intermediate pressure of approximately 10 kg/cm$^2$ and then, seritim, such pressure-reduced medium is evaporated and warmed up in the evaporative heat exchanger 37 and then, in countercurrent to the natural gas, in the heat exchanger 50. Furthermore, the two partial heat exchangers 31 and 32 of the FIG. 1 are united into a single heat exchanger 30 through which the natural gas flows, as a result of which the branch incorporating the throttle 13 in FIG. 2 can be omitted.

Finally, another embodiment of the present invention proposes that the incorporated cascade circuit be closed, the obtained low temperature cooling medium be utilized for liquifying a gaseous mixture, and that the cooling medium have substantially the same temperature during the phase separation as the gaseous mixture to be liquified as a liquid at or close to boiling conditions and under liquefying pressure.

The cooling medium which is cooled in the downstream cooler 19 need not necessarily be partially condensed; rather, such cooling medium can leave the downstream cooler 19, under certain circumstances, even in the form of a dry saturated or superheated steam.

It will be understood that each of the elements described above, or two or more together, may also find a useful application in other types of constructions differing from the types described above.

While the invention has been illustrated and described as embodied in a cooling arrangement for liquifying natural gas, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A cooling method that comprises cooling circuit means, wherein a circulating cooling medium is compressed and cooled by an ambient cooling fluid and is condensed, expanded, warmed and evaporated, including at least one cooling circuit which is an incorporated cascade circuit that includes a fractional condensation wherein the cooling medium is partially condensed in a first heat exchange constituting an evaporative heat exchange with expanded and evaporating cooling medium and the partially condensed cooling medium is separated into its liquid and gaseous phases, the separated liquid phase being supercooled in a second heat exchange constituting a counter-current supercooling heat exchange, and being expanded and warmed to evaporate in a third heat exchange constituting a countercurrent evaporative heat exchange, and the separated gaseous phase is totally condensed in said third heat exchange, expanded and warmed in said second heat exchange, the warming of the expanded cooling medium in said second heat exchange and the warming of the expanded cooling medium in said third heat exchange being performed essentially in parallelism and said second and third heat exchanges being essentially thermally segregated from one another, the cooling medium in the incorporated cascade circuit being compressed in a plurality of compression stages to a relatively high pressure and cooling medium supercooled in said second heat exchange being expanded to a relatively intermediate pressure and recirculated to the input of a compression stage arranged downstream the first compression stage and the cooling medium totally condensed in said third heat exchange being supercooled, expanded to a relatively low pressure, warmed in said second heat exchange and recirculated to the input of the first compression stage.

2. A cooling method that comprises cooling circiuit means, wherein a circulating cooling medium is compressed and cooled by an ambient cooling fluid and is condensed, expanded, warmed and evaporated, including at least one cooling circuit which is an incorporated cascade circuit that includes a fractional condensation wherein the cooling medium is partially condensed in a first heat exchange constituting an evaporative heat exchange with expanded and evaporating cooling medium and the partially condensed cooling medium is separated into its liquid and gaseous phases, the separated liquid phase being supercooled in a second heat exchange constituting a countercurrent supercooling heat exchange, and being expanded and warmed to evaporate in a third heat exchange constituting a countercurrent evaporative heat exchange, and the separated gaseous phase is totally condensed in said third heat exchange, expanded and warmed in said second heat exchange, the warming of the expanded cooling medium in said second heat exchange and the warming of the expanded cooling medium in said third heat exchange being performed essentially in parallelism and said second and third heat exchanges being essentially thermally segregated from one another, the cooling medium in the incorporated cascade circuit being compressed in a plurality of compression stages to a relatively high pressure and cooling medium supercooled in said second heat exchange being expanded to a relatively intermediate pressure and warmed in a countercurrent heat exchange with a gaseous mixture to be liquefied and recirculated to the input of a compression stage arranged downstream the first compression stage, said countercurrent heat exchange being essentially thermally segregated from said second and third heat exchanges.

3. A method as defined in claim 2, wherein the cooling medium is admitted to said countercurrent heat exchange essentially as a liquid essentially in its boiling state.

4. A method as defined in claim 2, wherein the gaseous mixture to be liquefied is totally condensed in said countercurrent heat exchange.

* * * * *